US010948263B2

(12) United States Patent
Mack

(10) Patent No.: US 10,948,263 B2
(45) Date of Patent: Mar. 16, 2021

(54) LONG GUN SECURITY STORAGE CONTAINER

(71) Applicant: Hornady Manufacturing Company, Grand Island, NE (US)

(72) Inventor: Matthew Mack, Grand Island, NE (US)

(73) Assignee: Hornady Manufacturing Company, Grand Island, NE (US)

( * ) Notice: Subject to any disclaimer, the term of this patent is extended or adjusted under 35 U.S.C. 154(b) by 168 days.

(21) Appl. No.: 16/205,834

(22) Filed: Nov. 30, 2018

(65) Prior Publication Data

US 2019/0170477 A1 Jun. 6, 2019

Related U.S. Application Data

(60) Provisional application No. 62/593,651, filed on Dec. 1, 2017.

(51) Int. Cl.

| | |
|---|---|
| ***F41C 33/06*** | (2006.01) |
| ***E05G 1/04*** | (2006.01) |
| ***E05B 47/06*** | (2006.01) |
| ***E05G 1/00*** | (2006.01) |

(52) U.S. Cl.

CPC ..... *F41C 33/06* (2013.01); *E05B 47/06* (2013.01); *E05G 1/005* (2013.01); *E05G 1/04* (2013.01)

(58) Field of Classification Search

CPC ..... F41C 33/06; E05G 1/04; E05G 1/005; E05B 47/06; E05B 47/02; E05B 73/0005; E05B 2047/0017; E05B 65/5253; E05B 47/0607; E05B 65/5261; E05C 3/167; E05C 3/34

USPC ..... 70/63, 71–75, 84, 121–123, 159–162, 70/277, 278.1, 278.7, 279.1, 283; 292/11, 292/26, 47, 48, 201; 211/64; 42/70.11; 109/73, 74, 58, 64, 50–52, 59 R, 59 T; 248/551–553; 206/317; 224/912, 913

See application file for complete search history.

(56) References Cited

U.S. PATENT DOCUMENTS

| | | | | |
|---|---|---|---|---|
| 439,562 | A * | 10/1890 | Richards | |
| 1,240,981 | A | 9/1917 | Kohl | |
| 3,095,724 | A | 7/1963 | Truhon | |
| 3,354,570 | A | 11/1967 | Rizzo, Jr. | |
| 3,589,062 | A | 6/1971 | Desmond | |
| 4,342,207 | A | 8/1982 | Holmes et al. | |
| 4,446,798 | A * | 5/1984 | Withington | E05B 65/0075 109/59 R |
| 4,470,277 | A | 9/1984 | Uyeda | |
| 4,917,022 | A | 4/1990 | Ogasawara et al. | |
| 4,926,762 | A * | 5/1990 | Paul | B60R 7/087 109/23 |
| 4,964,286 | A | 10/1990 | Poyer | |
| 5,010,751 | A | 4/1991 | Schwartz et al. | |
| 5,056,342 | A | 10/1991 | Prinz | |
| 5,060,583 | A | 10/1991 | Stinson | |

(Continued)

*Primary Examiner* — Lloyd A Gall

(74) *Attorney, Agent, or Firm* — McHale & Slavin, P.A.

(57) ABSTRACT

A long gun storage container. The container includes a housing having a storage compartment and an opening providing access to the compartment. A door is hingedly mounted to the housing and is operable to selectively close the opening. A latch mechanism is provided to selectively lock the door in its closed position and provide multiple axis securement. A control system is provided to allow for electronic unlocking of the latch mechanism.

11 Claims, 10 Drawing Sheets

(56) References Cited

U.S. PATENT DOCUMENTS 5,111,199 A 5/1992 Tomoda et al.
5,170,919 A 12/1992 DeSantis et al.
5,236,086 A 8/1993 MacTaggart
5,280,755 A 1/1994 Batur
5,294,031 A 3/1994 Volpei et al.
5,374,919 A 12/1994 Zelka et al.
5,495,967 A 3/1996 Parton
5,579,909 A 12/1996 Deal
5,584,424 A 12/1996 Stava
5,632,166 A 5/1997 Wiersma
5,662,219 A 9/1997 Tschudy et al.
5,671,830 A 9/1997 Wood
5,683,021 A * 11/1997 Setina ..... B60R 7/14 206/317
5,687,896 A 11/1997 Clift
5,860,573 A * 1/1999 Hossack ..... B60R 7/06 211/64
5,881,584 A 3/1999 Brunoski et al.
5,924,565 A 7/1999 Colee
5,943,888 A 8/1999 Lawson
5,967,393 A 10/1999 Clarke, III
6,209,250 B1 4/2001 Mills
6,279,359 B1 8/2001 Boisvert
6,293,207 B1 9/2001 Do
6,318,134 B1 11/2001 Mossberg et al.
6,405,861 B1 6/2002 Siler et al.
6,570,501 B2 5/2003 Bushnell et al.
6,606,492 B1 8/2003 Losey
6,843,081 B1 1/2005 Painter
6,845,640 B2 * 1/2005 Loeff ..... E05B 53/003 109/45
6,876,756 B1 4/2005 Vieweg
7,143,913 B2 12/2006 Lindsey et al.
7,296,448 B1 11/2007 Shaw
7,434,427 B1 10/2008 Miresmaili
7,469,564 B1 12/2008 Shaw
7,537,117 B2 5/2009 Roesler
7,845,202 B2 12/2010 Padilla et al.
8,074,477 B1 12/2011 Weiche
8,104,313 B2 1/2012 Wolfe
8,157,181 B2 4/2012 Bates et al.
8,186,188 B1 * 5/2012 Brown ..... F41C 33/06 70/63
8,201,426 B2 6/2012 Heim et al.
8,726,704 B2 * 5/2014 White ..... A47B 88/60 70/63
8,826,704 B1 9/2014 Marshall
9,428,114 B2 8/2016 Mothersele
9,530,266 B2 12/2016 Delattre et al.
9,534,867 B2 1/2017 Dunn et al.
10,253,529 B1 * 4/2019 McGinn ..... E05B 35/00
2001/0010491 A1 8/2001 Marneweck et al.
2002/0047278 A1 * 4/2002 Pauser ..... E05B 65/5261 292/48
2003/0001724 A1 1/2003 Willats et al.
2003/0167693 A1 9/2003 Mainini
2003/0217574 A1 11/2003 Meis
2005/0235711 A1 10/2005 Martin et al.
2006/0065560 A1 * 3/2006 Dickinson ..... F41C 33/06 206/317
2006/0213239 A1 9/2006 Roatis et al.
2006/0283219 A1 12/2006 Bendz et al.
2007/0000965 A1 1/2007 Cannon, Jr.
2007/0018787 A1 1/2007 Martinez de Velasco Cortina et al.
2007/0257772 A1 11/2007 Marcelle et al.
2008/0047860 A1 2/2008 Shane
2008/0180211 A1 7/2008 Lien
2008/0256998 A1 10/2008 Mallian et al.
2008/0264309 A1 10/2008 Villiger
2009/0071208 A1 * 3/2009 Wang ..... E05B 47/0603 70/277
2009/0308116 A1 12/2009 Lambrou
2010/0025446 A1 2/2010 Eberle
2010/0171589 A1 7/2010 Haberli
2010/0194527 A1 8/2010 Loughlin et al.
2010/0236298 A1 9/2010 James et al.
2010/0243492 A1 9/2010 Bulthuis, Jr. et al.
2011/0162564 A1 7/2011 Heim et al.
2011/0174200 A1 7/2011 Bartel
2011/0247950 A1 10/2011 McGee
2011/0290837 A1 12/2011 Smith
2012/0152776 A1 6/2012 Camp
2012/0324968 A1 12/2012 Goren et al.
2013/0025511 A1 1/2013 Maxwell
2013/0055933 A1 3/2013 Markman et al.
2013/0133558 A1 5/2013 Andrews
2013/0134193 A1 5/2013 Mothersele
2013/0298616 A1 11/2013 Ullrich et al.
2014/0083338 A1 3/2014 McAlexander
2014/0116303 A1 5/2014 Mothersele
2014/0145819 A1 5/2014 Wall et al.
2014/0182489 A1 7/2014 Suggs et al.
2015/0047397 A1 * 2/2015 Lackey ..... E05B 63/143 70/69
2017/0046899 A1 2/2017 Delattre et al.
2018/0335275 A1 * 11/2018 Mack ..... E05B 65/0075
2018/0356172 A1 12/2018 Mack

* cited by examiner

LONG GUN SECURITY STORAGE CONTAINER

RELATED APPLICATIONS

In accordance with 37 C.F.R 1.76, a claim of priority is included in an Application Data Sheet filed concurrently herewith. Accordingly, the present invention claims priority to U.S. Provisional Patent Application No. 62/593,651, filed Dec. 1, 2017, entitled, "LONG GUN SECURITY STORAGE CONTAINER", the contents of the above referenced application are herein incorporated by reference in their entirety.

FIELD OF THE INVENTION

A lockable storage container for a long gun such as a rifle or shotgun.

BACKGROUND OF THE INVENTION

Storage for firearms has become an important issue. In particular, safer storage of firearms is desired. Numerous devices are available to improve the safety of a firearm during storage. Such devices include trigger locks, lockable containers, lightweight safes, and large, heavy, fire resistant safes. While effective, each has its advantages and disadvantages. A trigger lock, although misnamed because it does not "lock" the trigger, shields the trigger from use, but provides no other protection, for example, protection from theft or movement. Lockable containers are typically small and designed for the securement of handguns. Lightweight safes can accommodate long guns, like rifles and shotguns, and can be removed from a building with their contents. They do not prevent damage from fire, and cannot typically be transferred to a vehicle for transport with a firearm therein. Large safes have the advantages of the small lightweight safes, but provide resistance to fire damage; however, they cannot be used in a vehicle or easily moved about a building.

There is thus a need for a storage container for long guns that can be used to improve the security of storing a long gun at a building, and can also be used in a portable manner in a vehicle.

DESCRIPTION OF THE PRIOR ART

Safes capable of storing long guns in a manner that both secure the gun and preclude its viewing when closed are well known. The lightweight safes are designed to hold a plurality of guns, but are made out of light gauge metal out of necessity, which can allow for unauthorized opening of the door with prying tools. The heavyweight safes preclude prying a door open, basically, by the use of heavy gauge metal that, in practical terms, cannot be pried open with simple prying tools. Both of these types of safes tend to be large and non-portable, allowing their user to secure a firearm both in a home or other building. While lightweight safes can be easily moved, they cannot be easily stored out of sight in a vehicle. Heavyweight safes cannot be easily moved or transported out of sight in a vehicle. Both types of safes are similar in their general construction. They have a pair of side walls, a back wall, and top and bottom walls. They also have a door that is hingedly mounted for movement between open and closed positions. Such safes also include a latch mechanism that releasably secures the door in its closed position. Typically, a key lock or combination lock secures the latch mechanism in its door closed configuration. Heavy safes typically include a plurality of locking bolts mounted in the door that are each movable into an opening in a frame around the door. Lightweight safes use a much simpler mechanism for latching the door in its closed condition, but allow a prybar to be inserted between an edge of the door and an edge of the door frame to pry the door open, either by bending the latch mechanism and/or the frame. Adding reinforcement to the door frame on a light weight safe, because of the length of the door frame, is not always practical or effective. In addition, it adds to the weight and expense of the safe.

SUMMARY OF THE INVENTION

It is an objective of the present invention to provide a long gun storage container that can be used for storage, both in a building and a vehicle.

Accordingly, it is a primary objective of the instant invention to provide such a gun storage container with an improved latch mechanism.

It is a further objective of the instant invention to provide such a gun storage container that can be manually or electronically unlocked.

It is yet another objective of the instant invention to provide such a gun storage container that is adapted for the storing of a single long gun.

It is a still further objective of the invention to provide such a gun storage container that can be secured in place in either a vehicle or in a building.

Other objects and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
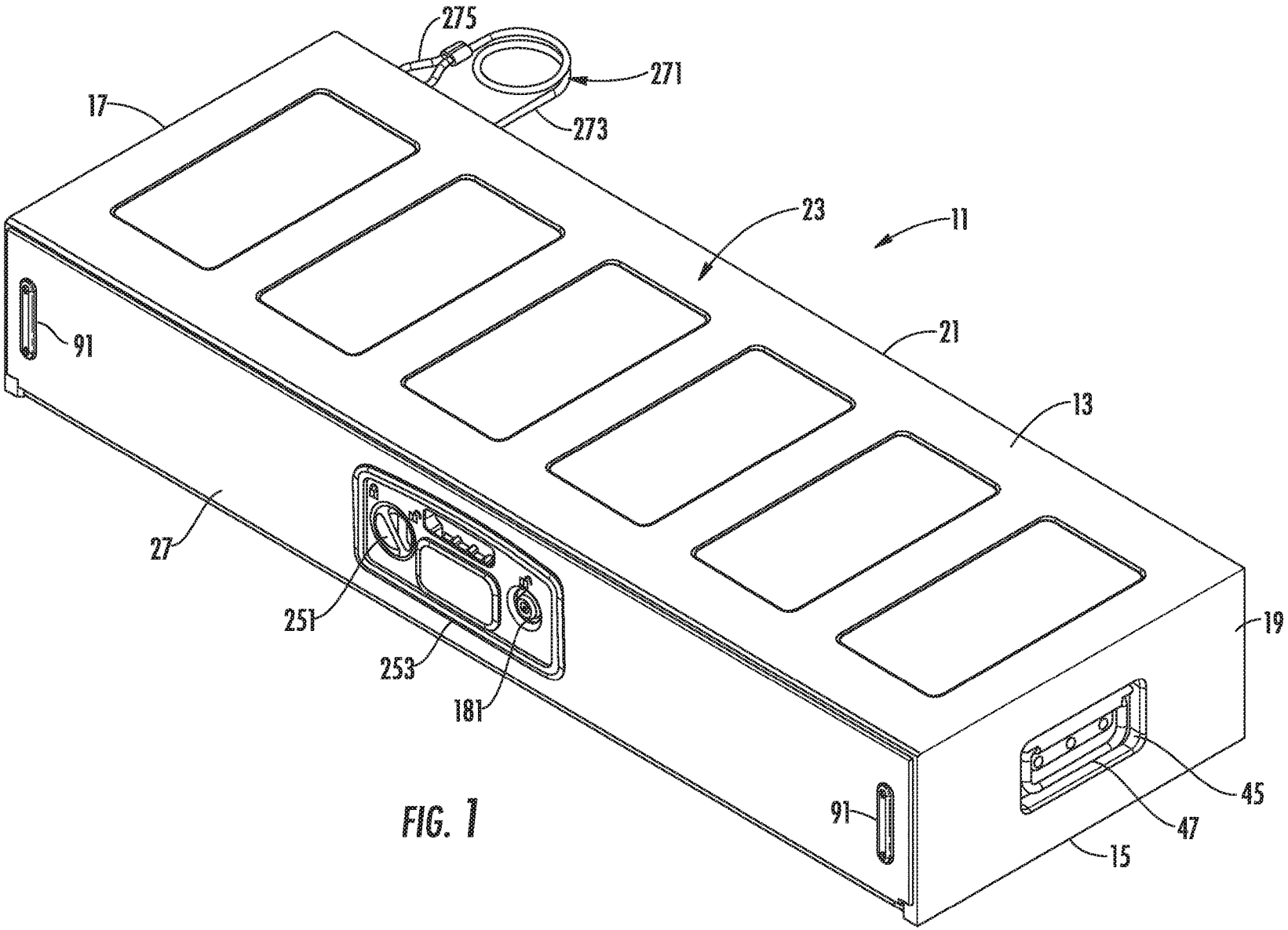
FIG. 1 is an isometric view of a long gun storage container shown with a closed door.
Figure 2:
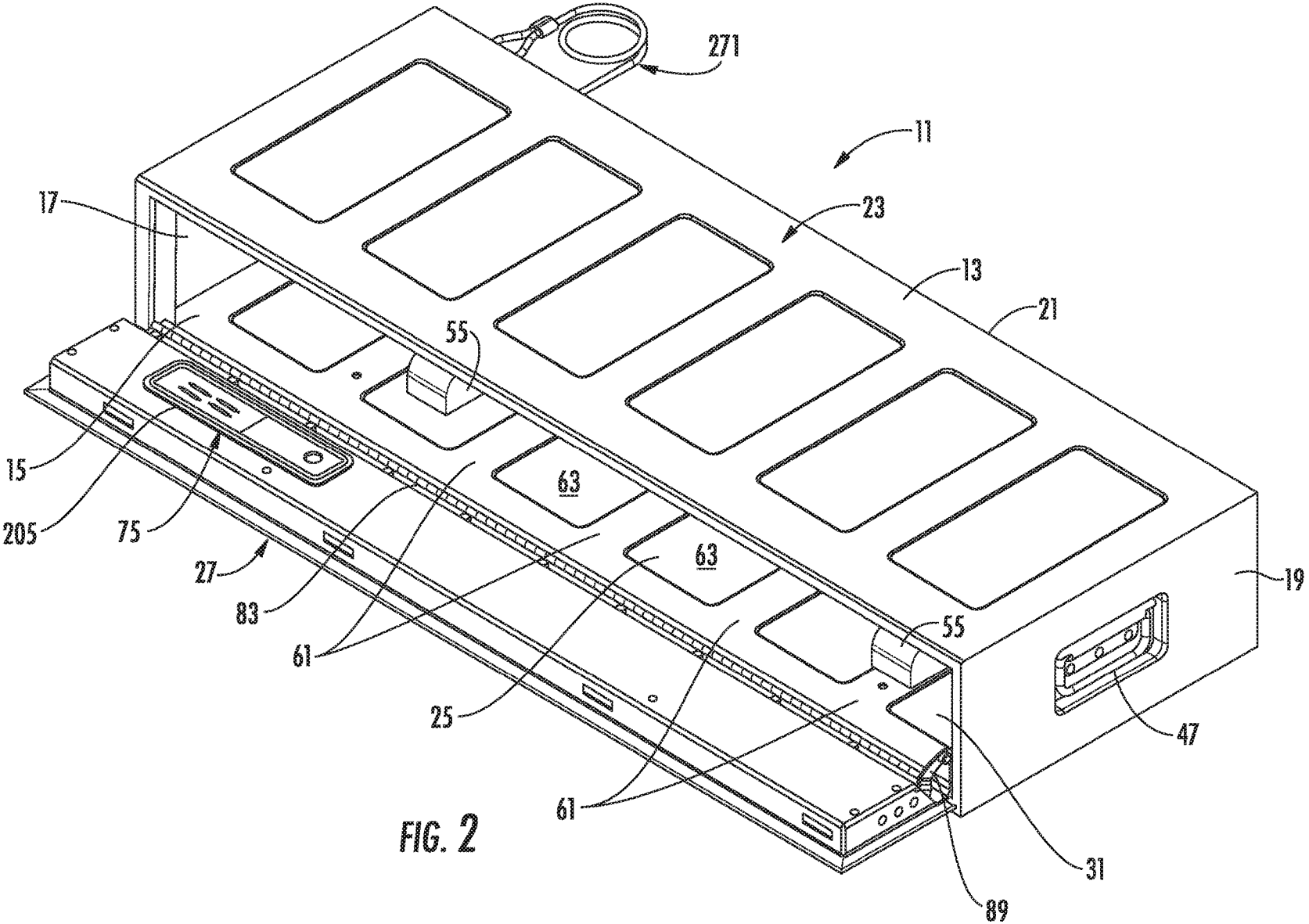
FIG. 2 is an isometric view of the long gun storage container of FIG. 1, shown with the door open.
Figure 5:
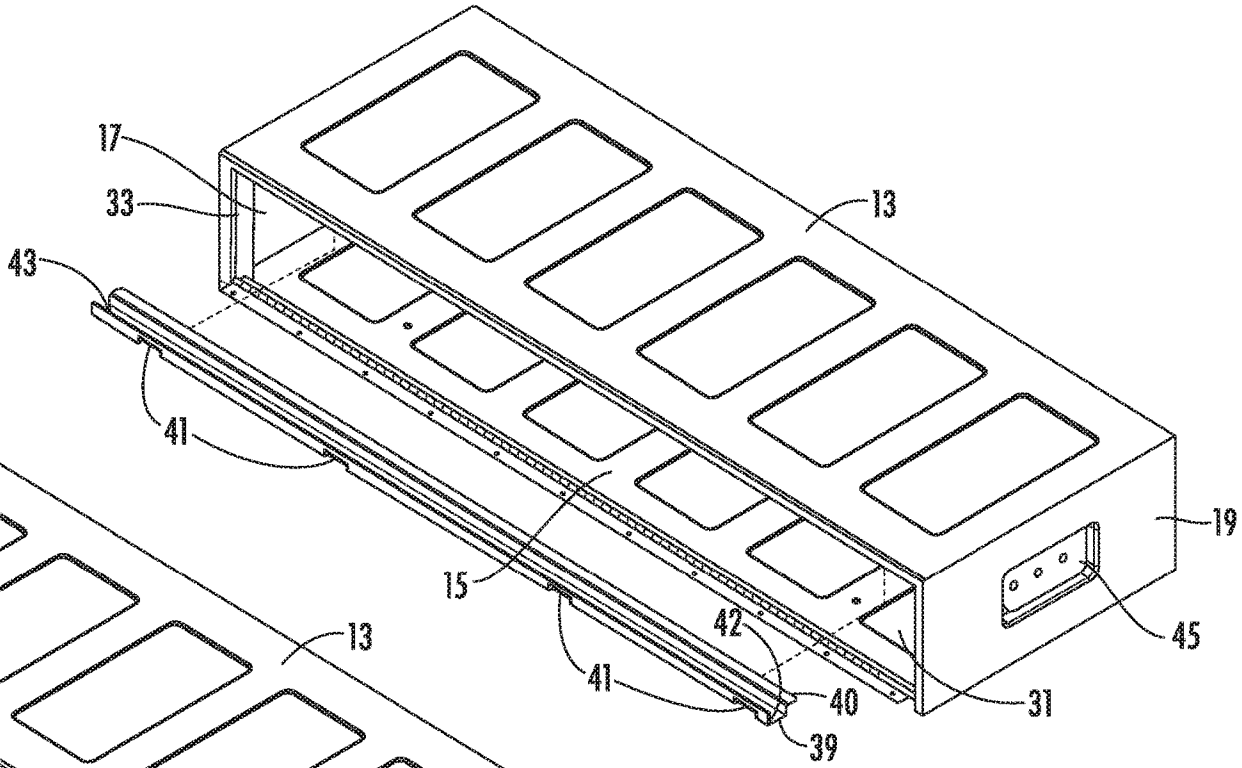
FIG. 5 is an exploded isometric view of a portion of the long gun storage container showing details of the housing.
Figure 4:
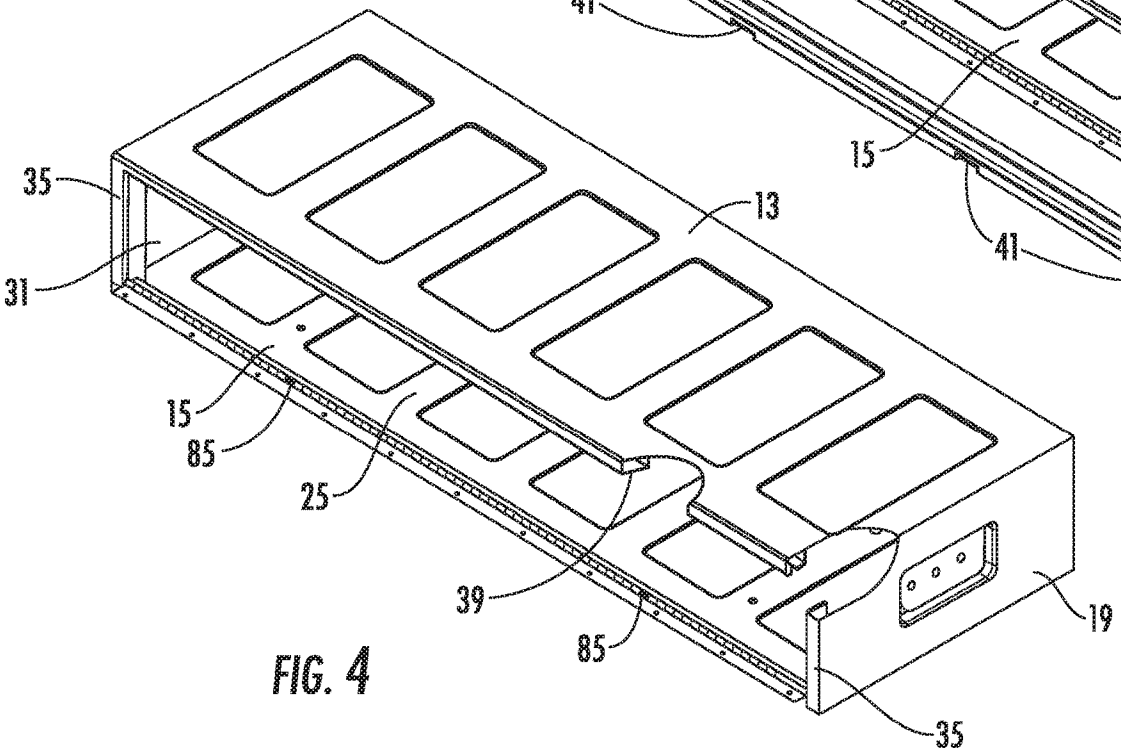
FIG. 4 is a partial isometric view of the long gun storage container with portions broken away to show structural details of the housing.

The reference numeral 11 designates generally a security storage container (safe) for use with long guns such as rifles (such as AR style rifles, bolt action rifles and the like) and shotguns (such as tactical shotguns, pump shotguns and self-loading shotguns). The container 11 is comprised of top and bottom side walls 13, 15, respectively, end walls 17, 19 and a back wall 21. The walls 13, 15, 17, 19 and 21 form a housing 23 that has a storage chamber 25 therein. The use of orientation terms such as bottom, top and back are used in the sense of when the container 11 is in its normal orientation with the bottom wall 15 resting on a supporting surface. The container 11 also has a door 27 that is mounted to the housing 23 for a hinged movement between an open position, as seen in FIG. 2, and a closed position, as seen in FIG. 1. Preferably, the door 27 and the walls 13, 15, 17, 19 and 21 are formed of a metal material, such as steel. The walls 13, 15, 17, 19 and 21 can be suitably joined together as by welding and/or by forming bend joints between various panels forming the walls. The door 27 is received in an opening 31 defined by a door frame 33. As best seen in FIGS. 4, 5, the door frame 33 is comprised of U-shaped channel portions 35 on the front edge of the end walls 17, 19, providing door engaging faces. In a preferred embodiment, the door frame 33 also includes a U-shaped channel 39 that is suitably secured to the inside surface of the top wall 13 adjacent its front edge. The channel 39 can be secured to the wall 13, as by spot welding a flange 40 to an inside surface of the top wall 13. As seen in FIG. 5, the channel 39 is provided with a plurality of, for example four, latch receiving through slots 41 through a bight 42 having an interior latch surface 43 for engaging a respective latch throat surface 143 described below and shown in FIG. 7. The slots 41 open toward the inside surface of the front edge of the bottom wall 15. As best seen in FIG. 1, the end walls 17, 19 are each provided with a handle recess 45, in which is suitably secured a handle 47 that is pivotally movable between a storage position, as shown in FIG. 1, and an extended position for gripping by a user's hand to move or carry the container 11. It is to be understood that only one of the end walls 17, 19 can be provided with a recess 45 and handle 47.

Figure 3:
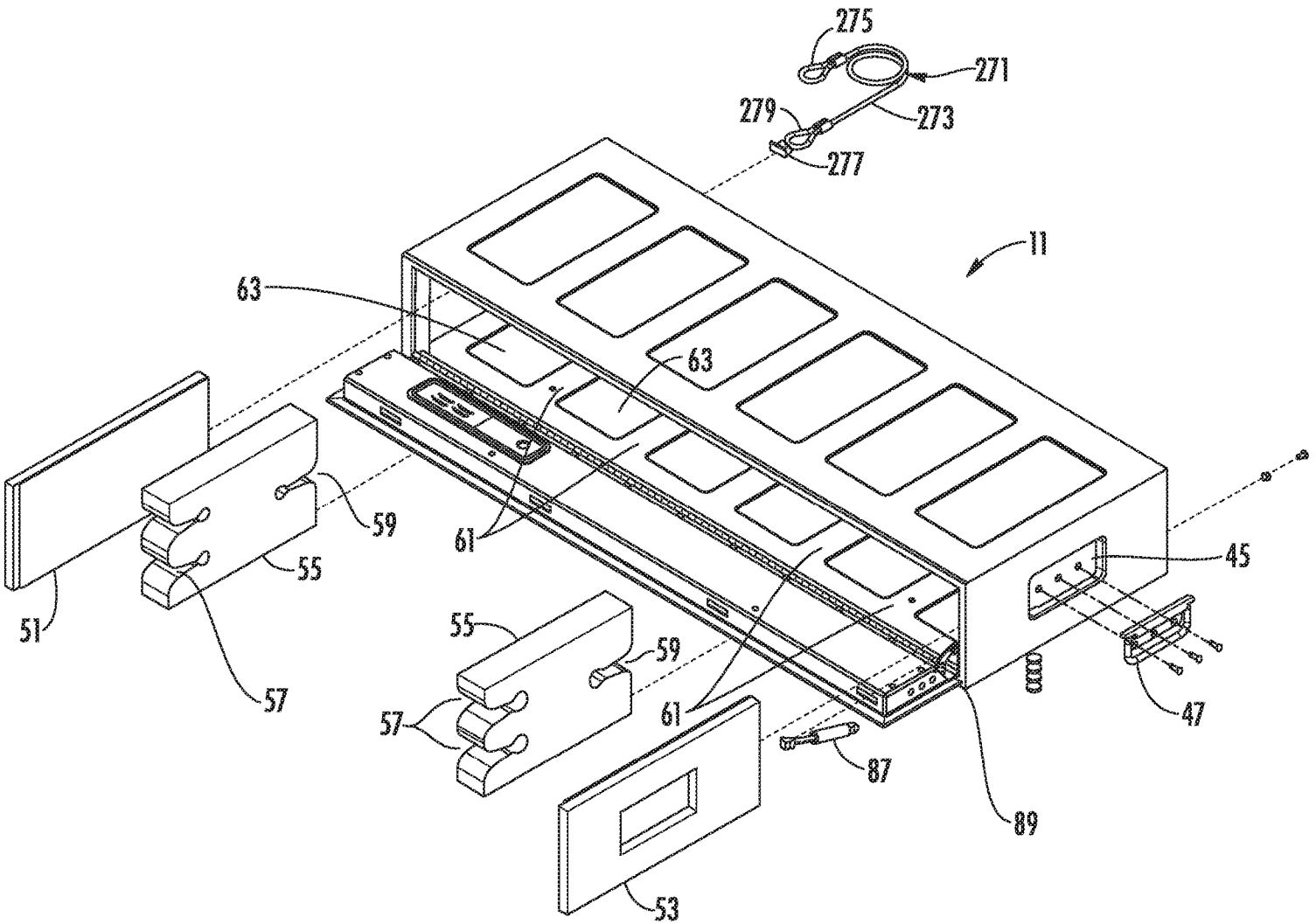
FIG. 3 is an exploded isometric view of the long gun storage container.

As seen in FIG. 2 and FIG. 3, the container 11 can be provided with suitable cushioning that will hold a firearm within the chamber 25 to resist a firearm from contacting any of the walls 13, 15, 17, 19 and 21. End wall cushions 51, 53 can be suitably secured in the chamber 25 to resist contact between a firearm and either of the end walls 17, 19. For example, the cushions 51, 53 may be removably mounted, as by having one end thereof positioned within the channels formed by the channel members 35. The cushions 51, 53 may also be adhesively secured to their respective end wall 17, 19. Firearm supporting cushions 55 can also be suitably removably mounted within the chamber 25 at positions between the end walls 17, 19 and retained between the top and bottom walls 13, 15. The cushions 55, as shown, have a double slot 57 arrangement on one end face and a single slot 59 on an opposite end face. This allows for storing two firearms or a single firearm, depending on the orientation of the cushions 55. The cushions 55 can be held in place by friction, thus facilitating their selective reorientation. In addition, the walls 13, 15 can have grooves 61 formed between adjacent raised panel portions 63 for receiving the cushions therein. The cushions 51, 53 and 55 can be made of a polymeric foam of either an open cell or closed cell type. A suitable foam can be a polyethylene foam.

Figure 6:
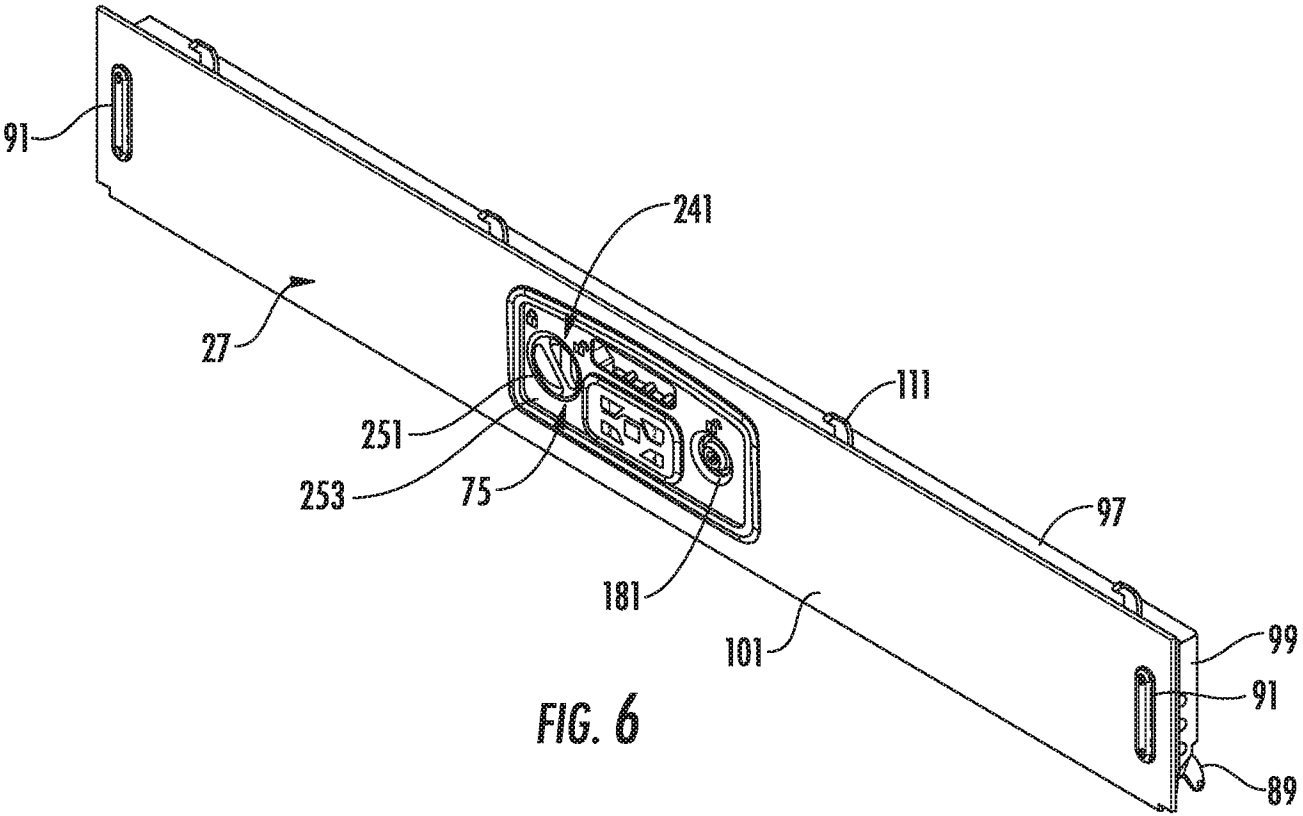
FIG. 6 is an isometric view of the door for the long gun storage container with the latch shown in a latch closed position.
Figure 7:
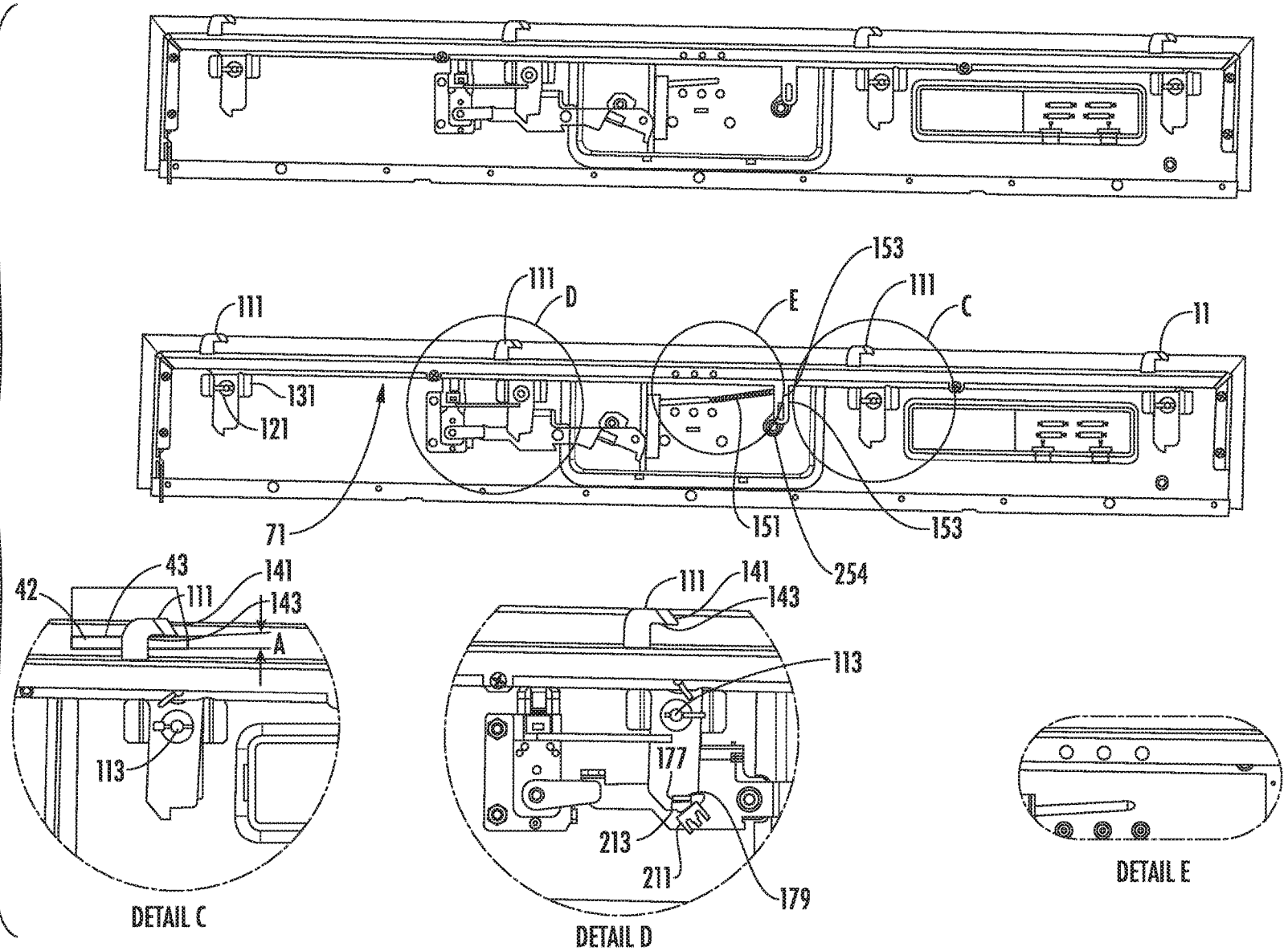
FIG. 7 is a side plan view of the inside of the door with portions of the detail enlarged.
Figure 8:
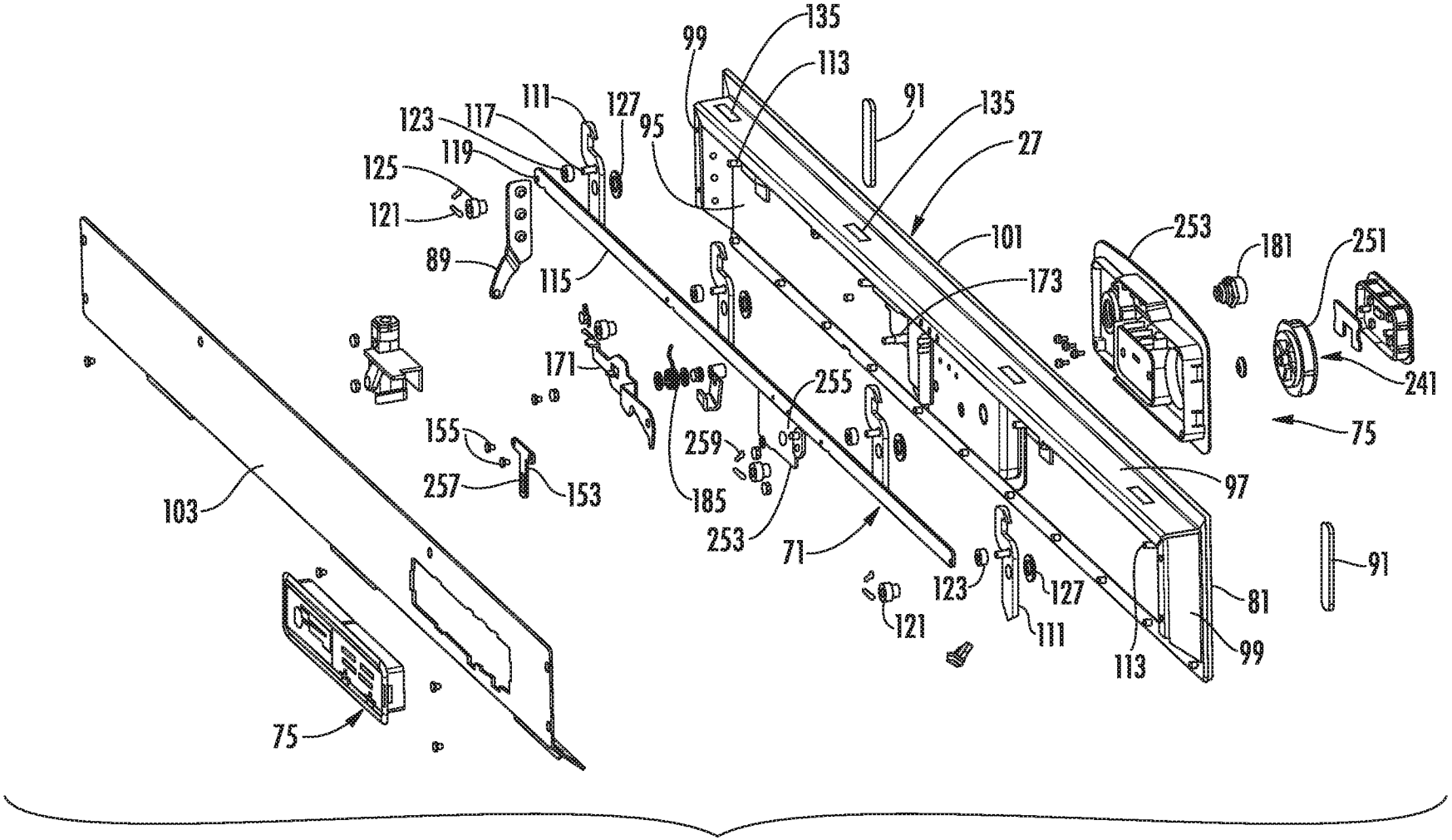
FIG. 8 is an exploded isometric view of the door.

As best seen in FIGS. 6, 7, and 8, the door 27 is provided. The door 27 carries a latch mechanism, designated generally 71, and a latch mechanism control system, designated generally 75. Some of the control system 75 is accessible from the exterior as described herein. The door 27 includes a front panel 81 that is hingedly mounted to the bottom wall 15, as by an elongate hinge 83, FIG. 2, which is suitably secured to the panel 81 and the wall 15 as by spot welding or rivets. A suitable hinge 83 can be a so-called piano hinge that extends substantially the entire length of the opening 31. The hinge 83 can be resiliently biased to an open position by a plurality of torsion springs 85, FIG. 4, suitably mounted to portions of the hinge 83. Soft opening of the door 27 can be provided by the use of a so-called air spring 87, FIG. 3, having one end secured to the end wall 19 and one end secured to an arm 89, which in turn is secured to the door 27. The exterior of the door 27 can be provided with one or more projecting bumpers 91, such that when the door 27 is moved to its open position, a space is provided to resist contact of an exposed portion of the control system 75 with an underlying surface. The door 27 includes structure to provide a compartment 95 sized and shaped to house components of the latch mechanism 71 and prevent their contact with a stored firearm. As shown, the compartment 95 is defined by a top flange 97 and side flanges 99 secured to an interior surface of a front panel 101 of the door 27. The flanges 97, 99 can be suitably secured to the panel 101 as with rivets, threaded posts and nuts and/or spot welding. An interior panel 103 is secured to the flanges 97, 99 as with screw fasteners, closing the back of the compartment 95.

The latch mechanism 71 is best seen in FIGS. 7, 8. The latch mechanism 71 has component parts thereof mounted to the door 27 and is operable to selectively lock the door 27 against opening movement when the door is in a closed position, as seen in FIG. 1. The latch mechanism 71 includes a plurality of latches 111 pivotally mounted to the door 27, as on posts 113 secured to the panel 101. The latches 111 are operably connected to one another in a manner to effect simultaneous movement of the latches. As shown, the latches 111 are connected by a link 115. The link 115 is pivotally mounted to each of the latches 111, as by having a pivot pin 117 secured to and extending from each of the latches 111 and through a respective through bore 119. A suitable mechanical fastener 121, such as a cotter pin, can be used to effect mounting securement of the link 115 to each of the posts 117. Suitable spacers and friction reducing elements 123 and 125 can be provided if desired. Also, a spacer 127 can be provided and positioned between a latch 111 and each of the mounts 131 secured to the front panel 101 that effects spacing of the latches 111 from the panel 101 and positions them for extending through a respective latch slot or opening 135 in the flange 97. The latches 111 are movable into and out of a respective latch opening 135, and into and out of a respective slot 41. As shown, the latches 111 have substantially the same construction to facilitate manufacture. The latches 111 have a hook 141 on a distal end thereof. A hook 141 is received in a respective slot 41 and has a throat surface 143 that engages a surface 43 of the channel 39 adjacent a respective slot 41 to assist in latching the door 27 in its closed position. The surface 143 has a negative rake angle A of preferably at least 2 degrees, and more preferably at least 4 degrees, relative to the surface 43 of bight 42. Thus, the latch 111 provides multi axis securement against opening movement of the door 27 relative to the housing 23 and, in particular, the door frame 33. This arrangement resists prying of the door 27 when closed to move about the hinge 83, and also resists prying the channel 39 away from the flange 97 and accidental unlatching if the container 11 is dropped. In a preferred embodiment, the latches 111 are resiliently biased in their latch position, as seen in FIG. 7. This can be done by a mechanical means, such as a tension spring 151 with one end secured to the main panel 101 and the other end secured to the link 115 via a finger 153 suitably secured to the link 115 as with mechanical fasteners 155.

Figure 11:
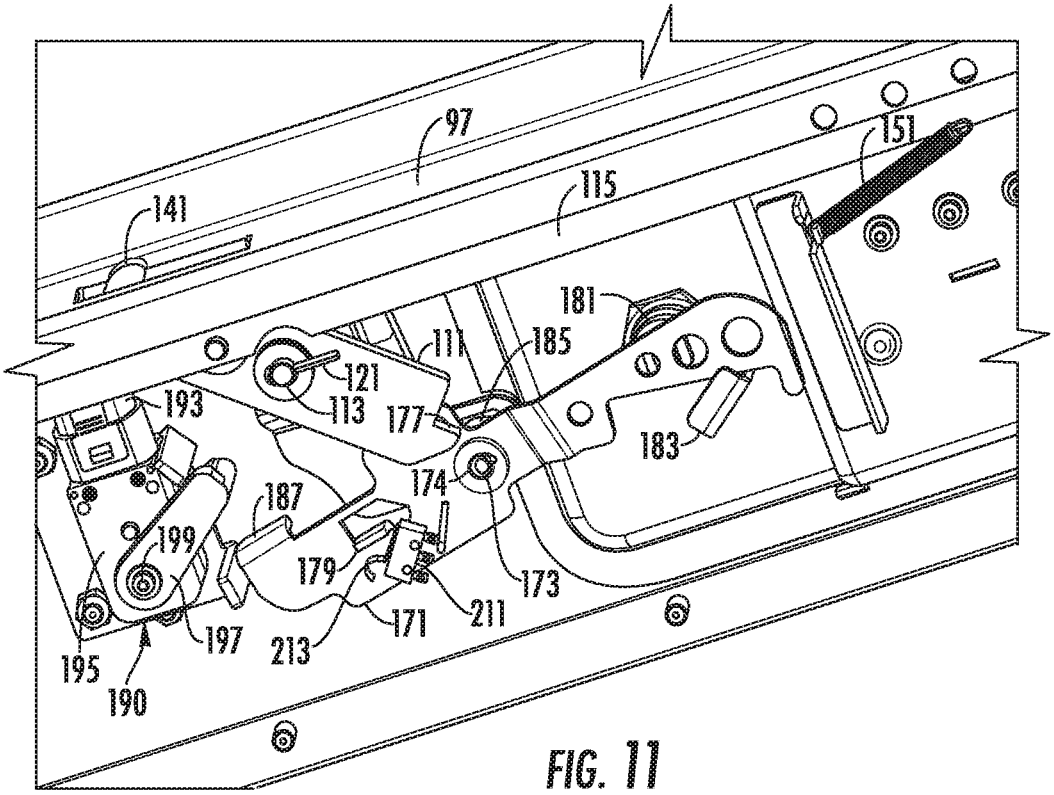
FIG. 11 is an isometric view of a portion of the latching mechanism shown in an unlatched configuration.

The control system 75 includes means for releasably retaining the latches 111 in their door latching position, as seen in FIG. 7 and FIG. 11. A sear plate 171 is pivotally mounted on the panel 101 of the door 27, preferably on a post 173, and maintained on the post 173 with a suitable fastener 174, as with a cotter pin or the like. The sear plate 171 preferably has a center of mass approximately at its pivot point about the post 173, i.e., to resist rotation thereof if the container 11 is dropped. A latch 111 cooperates with the sear plate 171 to maintain the latch in its normally latched position. The sear plate 171 is operable to selectively release the retained latch 111 to move to its unlatched position, as seen in FIG. 11, with the other latches 111 following because of their connection via the link 115. One end of the latch 111 is provided with a stop foot 177 on the end thereof, opposite the distal end with the hook 141. The foot 177, as seen in FIG. 7, engages a sear 179 to hold the latch 111 in its latching position, as seen in FIG. 7. When released, the latch 111 moves to its unlatched position, as seen in FIG. 11, under force influence of the extension spring 151, i.e. counterclockwise as seen in FIG. 11. A key lock 181, part of the control system 75, is accessible from the outside of the container 11, and can be used to move the sear plate 171 to its unlatched position. The key lock 181 can be of any suitable type and mounted to the door 27 to prevent the lock housing from rotating relative to the door 27. An arm 183 is secured to an internal portion of the lock 181, such as when a user uses a key to effect unlocking. The arm 183 will pivot counterclockwise, as seen in FIG. 11, and move the sear plate 171 in its counterclockwise direction to effect pivoting movement of the latches 111 to their unlatched position. To effect relocking, the lock 181 is moved back to its lock position, i.e., clockwise as seen in FIG. 11, which then frees the sear plate to move back to its locking position, as seen in FIG. 7. A torsion spring 185 is mounted on the post 173 to resiliently bias the sear plate 171 to rotate back to its locking position, as seen in FIG. 7. The sear plate 171 is provided with a foot 187 for cooperation with portions of the control system 75, as described below.

Figure 9:
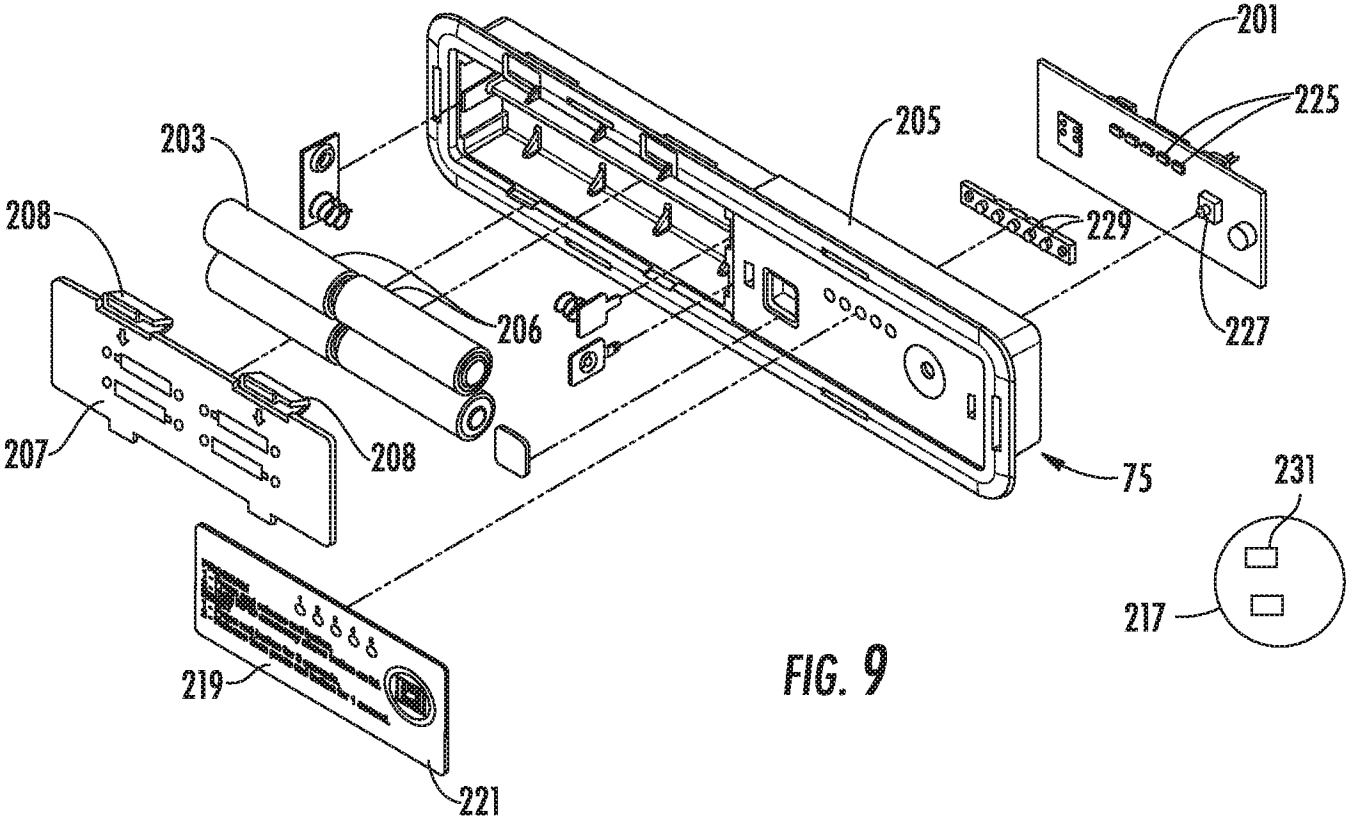
FIG. 9 is an exploded isometric view of the power source and controller.

The control system 75 is operable to effect operation of the latch mechanism 71 to effect latching and unlatching of the door 27 for selectively securing the door closed and allowing opening movement of the door. The control system 75 includes the spring 185 as described above. The control system 75 also includes the sear plate 171 pivotally mounted to the door and movable between a latched position and an unlatched position as described above. An electrical actuator 190 is provided to selectively effect pivoting movement of the sear plate 171. The actuator 190 includes an electric motor 193 mounted to the door 27. In a preferred embodiment, a right angle gear drive 195 is coupled to the motor 193 and has an actuator arm 197 rotatably movable with a gear drive output shaft 199. When the motor 193 operates, the gear drive 195 will cause rotary motion of the actuator arm 197 to engage the foot 187 of the sear plate 171 and effect its pivoting movement about the post 173 upon receiving electricity in response to control commands from operation of an electronic controller 201, as seen in FIG. 9. A conductor (not shown) connects the motor 193 to a power source 203 and controller 201 contained within a controller housing 205. It is to be understood that the power source can include batteries 206 and/or a power cord (not shown) for plugging into an AC outlet. The orientation of the batteries 206 in the power source 203 can be displayed on an access panel 207. The access panel 207 and access to the power source 203 is preferably provided on the inside of the door 27. The access panel 207 is removably mounted to the housing 205 as through the use of a click lock device 208.

Movement of the actuator arm 197 to pivot the sear plate 171 is operable to move the sear plate to its unlatched position, allowing the link 115 to move the latches 111 to their unlatched position and release the door 27 to move to its open position. To effect reverse rotation of the arm 197, the controller 201 can be provided with means to detect an overload condition in the motor 193 to then automatically effect reverse rotation of the motor 193. A timer could be used in place of a load sensor to signal the arm 197 and the motor 193 to rotate for a certain amount of time and then automatically reverse. Reverse rotation of the arm 197 moves it back to a position allowing the sear plate 171 to move back to its latching position, as seen in FIG. 7.

The control system 75 can include a switch 211. The switch 211 has a switch actuator 213 that is positioned to engage an end of the latch 111 associated with the sear plate 171. When the sear plate 171 is in its latched position, the switch 211 is actuated, providing a signal to the controller 201. This then turns the controller off to the extent that it cannot be programmed or reprogrammed when the door 27 is closed, providing an extra level of security. It also signals the controller 201 when the door 27 is closed.

Figure 10:
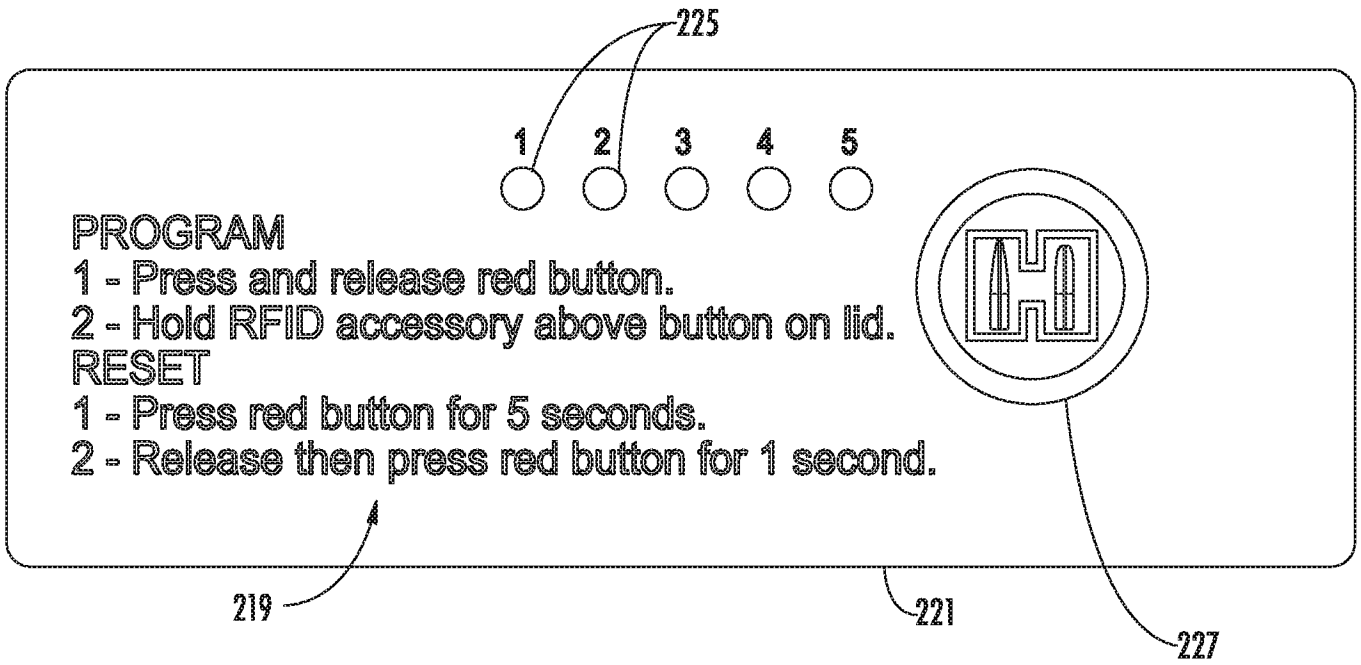
FIG. 10 is a front plan view of an instruction panel.

As seen in FIGS. 9 and 10, means is provided to effect programming of the controller 201 to a particular input signaling device, for example an RFID tag contained in a key type fob 217 or the like. Instructions 219 can be provided on a display panel 221 that can provide instructions on initial programming or reprogramming of the controller 201. A display, such as a plurality of lights 225, can also be provided to indicate which of a plurality of controller input signaling devices is being programmed to work with a particular container 11. The lights 225 can provide light through a respective light tube 229 to the display panel 221. A programming button 227 can also be provided for programming or resetting the controller 201 in accordance with the instructions 219. For security purposes, programming can only be done when the door 27 is open.

The electronic controller 201 operation is preferably initiated wirelessly using an RFID interrogator in the controller in association with an RFID tag 231. The interrogator (not shown) can be part of the controller 201. An RFID tag 231 can be on a wrist band, in a key fob, or in a decal form attached to a device such as a cell phone. A wireless radio transmitter and receiver can also be used to effect opening. In addition to a wireless signal operation, the controller 201 can be provided with a touch pad (not shown) to enter a code that, if correct, will also effect opening of the door 27 as described herein. The controller 201 can be configured to accept a plurality of input codes or accommodate a plurality of different RFID tags or radio frequency transmitters. Biometric sensors could also be used to identify an approved user to effect unlocking and opening, and provide an input signal to the controller 201. Further, the controller 201 can be configured to turn off manually or automatically to conserve batteries. The controller 201 can provide an indicator, preferably visual such as an LED light, to indicate if the actuator is powered on with either AC or battery. Such an indicator can also show if the controller 201 needs to be turned on, if in battery saving mode, and provide a touch sensing switch means to effect powering the controller for opening the container 11.

Closing of the door 27 is effected by moving the door to its closed position. Mechanical means is provided to effect selectively moving the latches 111 to their latching position (locked) from their unlatched position (unlocked). This is best seen in FIGS. 6, 7. A driver 241 is mounted on the door 27 and has a portion exposed for user gripping and manipulation. The illustrated driver 241 includes a lever in the form of a lock knob 251 rotatably mounted on the door 27, and has a portion exposed to a user when the door is closed. As shown, the knob 251 is mounted in panel 253, which is in turn secured to and exposed on the exterior of the front panel 101 of the door 27. The driver 241 includes an arm 254 fixed to the knob 251 and rotatable therewith, forming a lever arrangement. The arm 254 is operably coupled to the link 115 via the finger 153 with a pin 255 extending through an elongate slot 257 in the finger 153, as seen in FIG. 8. The pin 255 is secured in the slot 257 with a fastener 259, such as a cotter pin. Rotation of the knob 251 acts as a lever to effect manual movement of the link 115, and hence the latches 111 from their latch open position to their latch closed position. Operation of the driver 241 to effect movement of the latches 111 from the latch closed position to the latch open position is precluded by the actuator arm 197 and sear plate 171 being in their latched positions, as seen in FIG. 7, and the mechanical advantage provided by the gear drive preventing manual rotation of the arm 197. Additionally, the sear plate 171 locks the latches 111 in their latched positions.

As seen in FIGS. 1-3, a tether 271 is provided to secure the container 11 within a structure, such as a building or vehicle. The tether 271 is in the form of a cable 273, preferably metal, that can be polymeric coated. One end of the cable 273 has a loop 275 operable to secure the tether 271, such as to a bed frame, seat frame, wall, or floor anchor. The loop 275 is large enough to receive a lock shackle or a portion of the cable 273 therethrough to form a second larger loop. One end of the cable 273 is secured to the housing 23 as with a suitable connector 277 extending through a hole in one of the walls 13, 15, 17, 19 and 21. In FIG. 3, the connector 277 is shown as attached to the cable 273 using a second cable loop 279.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A gun safe comprising:

a housing having a top wall, a bottom wall, a front wall, a pair of end walls and a back wall joined together forming a storage chamber therebetween, and a door frame forming an opening into the storage chamber, said door frame having a plurality of spaced apart through latch openings along one edge thereof;

a door hingedly mounted to one of said walls opposite said one edge having said latch openings and selectively movable into and out of said opening, and substantially closing said opening when in a closed position;

a latch mechanism mounted to said door and operable to selectively lock said door against opening movement when said door is in said closed position, said latch mechanism including a plurality of latches pivotally mounted to said door and operably connected to one another with a link operable to effect simultaneous movement of said latches, each said latch being movable into and out of a respective said latch opening, at least one of said latches having a hook on a distal end thereof to engage an interior surface of the frame adjacent its respective said latch opening, providing multi axis resistance to opening movement of said door and said frame relative to one another; and a latch mechanism opening and closing control system operable to effect operation of said latch mechanism to effect latching and unlatching of said door for selectively securing said door closed and allowing opening movement of said door, said system including a sear plate pivotally mounted to said door and movable between a latched position and an unlatched position, and an electrical actuator mounted to said door operable to move said sear plate to its unlatched position, allowing said link to move the latches to an unlatched position and release said door to move to its open position, said system also including first means operable to selectively effect movement of said link and said latches to the latch open position and second means operable to selectively effect movement of said link and said latches to the latch closed position.

2. The gun safe of claim 1 wherein said first means including an extension spring connected to a portion of said latch mechanism and a portion of said door and operable to provide an opening movement force to said latch mechanism.

3. The gun safe of claim 1, wherein the second means including a driver movably mounted on said door and operably associated with one of said link or at least one of said plurality of latches to effect selective movement thereof to effect latching of said door in its closed position.

4. The gun safe of claim 3, wherein said driver including a lever.

5. The gun safe of claim 4, wherein said lever includes a knob rotatably mounted on said door.

6. The gun safe of claim 1 including at least one bumper secured to said door projecting therefrom and operable to prevent contact of said door with an underlying surface when open.

7. The gun safe of claim 1, wherein said at least one hook having a throat surface, and wherein the door frame including a member having said latch openings therethrough, said member having a latch surface positioned to engage said throat surface to selectively retain said door against opening movement and resist moving said door frame away from said door when said latches are in a door latching position.

8. The gun safe of claim 7, wherein said throat surface has a negative rake angle with respect to said latch surface.

9. The gun safe of claim 8, wherein a plurality of said latches, each having a said hook and a respective said associated throat surface.

10. The gun safe of claim 9, wherein said sear plate having a center of mass approximately located at its pivot center.

11. The gun safe of claim 1 including at least two cushions removably mounted in the storage chamber, said cushions each having a double slot arrangement opening on one end face thereof, and a single slot opening on an opposite end face for retaining at least one firearm in the storage chamber.

* * * * *